United States Patent [19]

Muraki et al.

[11] Patent Number: 5,043,497

[45] Date of Patent: Aug. 27, 1991

[54] LUBRICATING OIL FOR TRACTION DRIVES

[75] Inventors: Masayoshi Muraki; Hajime Yoshida, both of Kanagawa; Koji Tsuchimoto, Chiba, all of Japan

[73] Assignee: Mitsubishi Oil Co., Ltd., Tokyo, Japan

[21] Appl. No.: 412,748

[22] Filed: Sep. 26, 1989

[30] Foreign Application Priority Data

Sep. 26, 1988 [JP] Japan ..... 63-239061

[51] Int. Cl.[5] ..... C07L 13/18

[52] U.S. Cl. ..... 585/20; 585/21; 252/9; 252/73

[58] Field of Search ..... 585/20, 21, 22; 252/73, 252/9

[56] References Cited

U.S. PATENT DOCUMENTS

| | | | |
|---|---|---|---|
| 4,556,503 | 12/1985 | Tsubouchi et al. | 585/20 |
| 4,784,843 | 11/1988 | Segnitz et al. | 585/20 |

FOREIGN PATENT DOCUMENTS

| | | | |
|---|---|---|---|
| 0082967 | 11/1982 | European Pat. Off. . | |
| 362673 | 9/1990 | European Pat. Off. | 585/20 |
| 1806401 | 10/1968 | Fed. Rep. of Germany . | |
| 1257474 | 12/1971 | United Kingdom . | |

*Primary Examiner*—Asok Pal

*Attorney, Agent, or Firm*—Sughrue, Mion, Zinn Macpeak & Seas

[57] ABSTRACT

A lubricating oil is disclosed, which mainly is composed of a naphthenic hydrocarbon having 19 carbon atoms comprising two cyclohexane rings which have methyl-substitution at the 1, 2 and 4 positions thereof, the two cyclohexane rings being linked by a methylene group.

1 Claim, 1 Drawing Sheet

FIG.
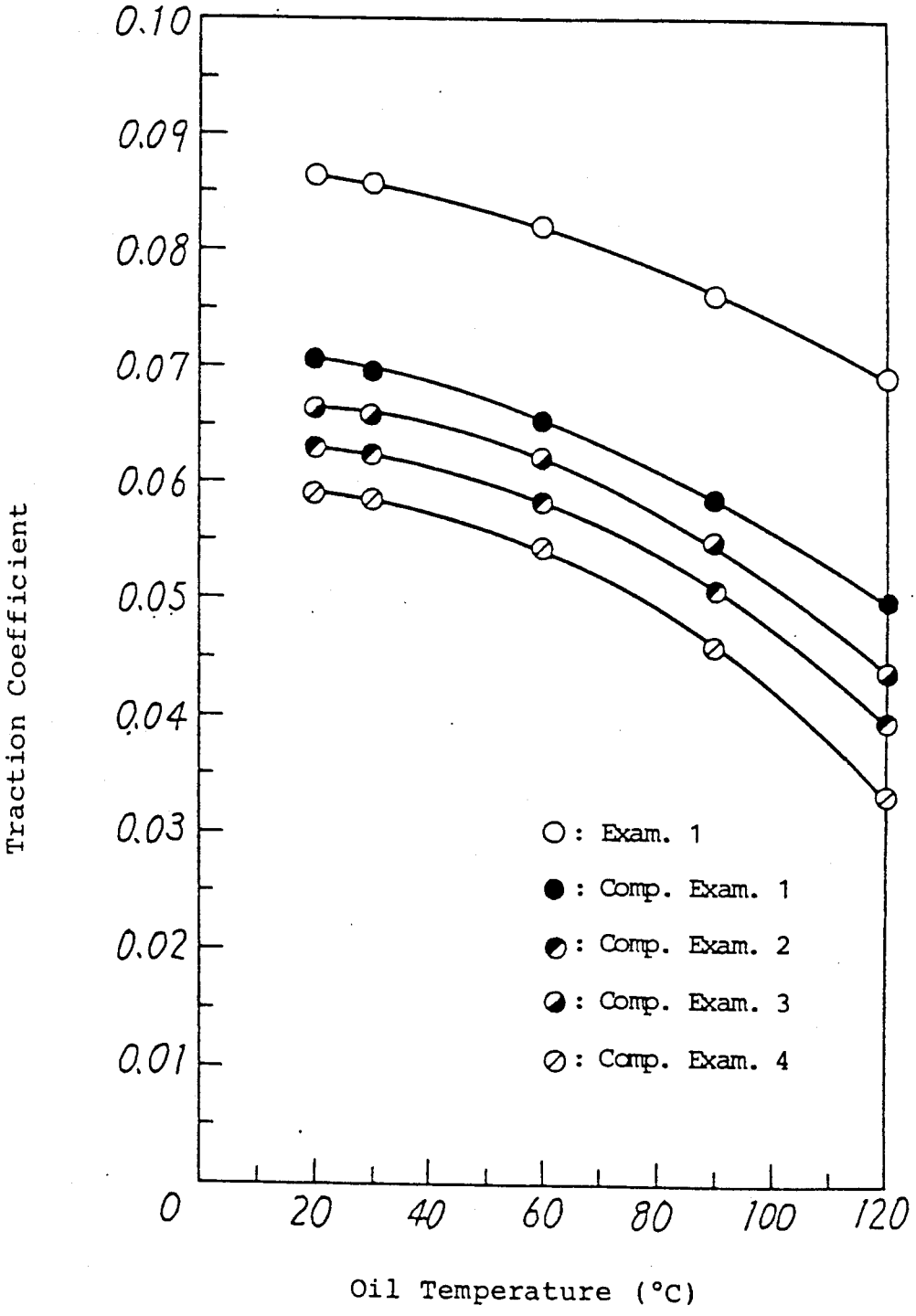

LUBRICATING OIL FOR TRACTION DRIVES

FIELD OF THE INVENTION

The present invention relates to a lubricating oil for traction drives More particularly, the present invention relates to a lubricating oil which has a high traction coefficient and a low viscosity over a wide temperature range from low temperatures to high temperatures, excellent stability to heat and oxidation, and excellent resistance to corrosion.

BACKGROUND OF THE INVENTION

For the purpose of power transmission, gear devices and pressure oil devices have been widely used. There is also known a method involving a traction drive which comprises transmitting power via an oil film between steel rotating members. Traction drives have also been used in industrial machinery because of the advantages that they generate little vibration and noise during operation (due to the absence of interlocking gears) and that they permit a continuously variable transmission. A study is underway to adopt traction drives to automobiles and agricultural tractors because traction drives provide energy transmission which results in energy saving.

In traction drives, the selection of a lubricating oil is very important because power is transmitted via an oil film present in the contact area between rotating members. Since power is transmitted by shearing of the oil film which becomes very viscous due to the high pressure at the contact area, it is preferred that the lubricating oil used in traction drives has a high shear resistance to obtain a high power transmitting performance.

As a measure of power transmitting performance, generally use is made of the traction coefficient which is the ratio of the tangential force to the perpendicular load. Also, low viscosity is preferred in order to minimize losses in power transmission due to resistance to agitation.

When traction drives are used in areas where the heat load is high, such as in the transmission of an automobile, the oil temperature rises to as high as 100° C. or more. The problem is then encountered of a decrease in the traction coefficient due to the increased temperature. It is important to minimize the decrease in the traction coefficient following such an increase in temperature.

The preferred lubricating oils for traction drives are naphthenic hydrocarbons and many are disclosed e.g., in JP-B-46-338, JP-B-46-339, JP-B-47-35763, JP B-48-42067, JP-B-48-42068, JP-B-61-15918, JP-B-61-15919 and JP-B-61-15920 (the term "JP-B" as used herein means an "examined Japanese patent publication").

The disclosed lubricating oils, however, are not fully satisfactory in performance because many of them have shortcomings, e.g., even if a high traction coefficient is exhibited at near room temperature, it decreases as the temperature rises or its efficiency is lowered due to high viscosity.

SUMMARY OF THE INVENTION

The objective of the present invention is to provide a lubricating oil for traction drives. More particularly, the present invention relates to a lubricating oil which has a high traction coefficient and low viscosity over a wide temperature range from low temperatures to high temperatures, excellent stability to heat and oxidation, and excellent corrosion resistance.

The present invention provides a lubricating oil for traction drives mainly composed of a naphthenic hydrocarbon having 19 carbon atoms made by linking, via a methylene group, two cyclohexane rings which have methylsubstitution at the 1, 2 and 4 positions thereof.

BRIEF DESCRIPTION OF THE DRAWING

The Figure presents a comparison between the traction coefficients of the Example .of the present invention and those of Comparative Examples at various temperatures.

DETAILED DESCRIPTION OF THE INVENTION

An example of the naphthenic hydrocarbons is a mixture composed of bis(2,3,5-trimethylcyclohexyl)methane;

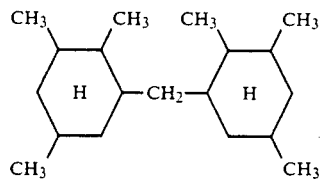

bis(3,4,6-trimethylcyclohexyl)methane;

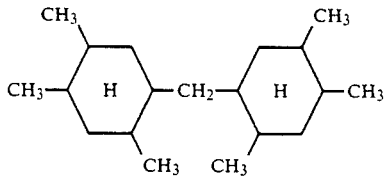

bis(2,3,6-trimethylcyclohexyl)methane;

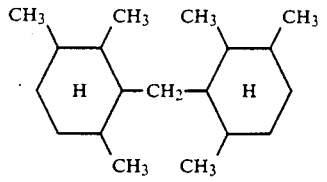

2,3,5-trimethylcyclohexyl-2',3',6'-trimethylcyclohexyl methane;

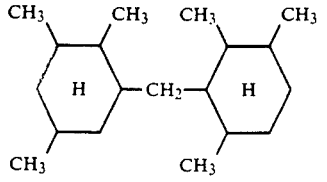

2,3,5-trimethylcyclohexyl-3',4',6'-trimethycyclohexyl methane;

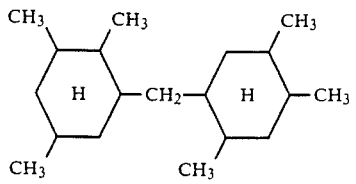

and 2,3,6-trimethylcyclohexyl-3',4',6'-trimethylcyclohexyl methane;

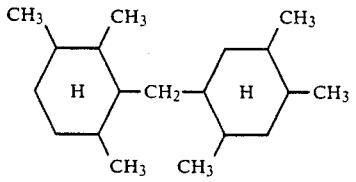

Separation of the above mixture into single compounds on an industrial scale is not only difficult but also unnecessary for carrying out the purpose of the present invention.

The purpose of the present invention is not hindered by the presence of a small amount of the by-product or by-products which is/are generated in the process of making the above compounds and in the process of hydrogenating the rings. However, the presence of a large amount of aromatic compounds or of compounds having double bonds is not preferred. When hydrogenating the aromatic hydrocarbons, the hydrogenation ratio is at least 90%, preferably not less than 95%.

The naphthenic lubricating oils obtained in the above manner exhibit excellent performance as lubricating oils for traction drives, and therefore can be used alone or in combination with not more than equivalent amounts of other lubricating oils, preferably naphthenic lubricating oils.

When using the lubricating oils for traction drives of the present invention for traction driving, additives for ordinary lubricating oils such as antioxidants, agents for increasing the viscosity index, corrosion inhibitors, detergents, defoamers and so forth are added as necessary. For example, there may be used alkyl phenols such as 2,6-di-tertiary butyl p-cresol or sulfur-phosphorus compounds such as zinc dialkyl dithiophosphate as anitioxidants, amines, esters or metallic salts as corrosion inhibitors, polymethacrylates as agents for increasing the viscosity index, calcium sulfonate as a detergent and silicone polymers as defoamers.

For measuring the traction coefficient, a roller tester is normally used, but in the present invention use was made of a 4-roller rolling friction tester which provides higher accuracy. Using this apparatus, one can measure the traction which is present at the three contact positions formed with a central inner roller and three outer rollers arranged at intervals of 120° under a predetermined load, temperature, peripheral speed and slip ratio.

All the rollers were of high carbon chromium bearing steel type 2 and had been heat treated to a Vickers hardness of 760–800.

TABLE 1

| Testing Conditions for Traction | |
|---|---|
| Average rotation: | 1,700 rpm |
| Average peripheral speed: | 3.56 m/s |

TABLE 1-continued

| Testing Conditions for Traction | |
|---|---|
| Load: | 135 kg |
| Average Hertz pressure: | 0.77 Gpa |
| Slip velocity: | 0–0.22 m/s |
| Temperature of feed oil: | 20–120° C. |

With respect to dimensions, the outer rollers each had diameter of 40 mm and a length of 10 mm, whereas the inner roller had diameter of 40 mm and length of 5 mm. The roughness of the rolling surface was reduced by finish cutting to a mean center line roughness of Ra=0.05 μm by cylindrical grinding. Table 1 shows the test conditions.

The procedure for the experiments was as follows: the rotating speeds of all the rollers were increased to the predetermined ones; in the meantime, each entire roller was heated with infrared rays so that the temperatures of the feed oil and the surface of the rollers were in the predetermined temperature range; apply the load; decrease the speed of the inner roller and increase the speed of the outer rollers while maintaining the average speed of the two at a constant value to thereby provide the desired slip; and continuously obtain the various values of the traction coefficient versus the slip ratio.

The traction coefficients obtained under the above conditions first linearly increased with the increase in the slip ratio, then gradually leveled off at a peak, and then decreased.

The practically important region lies in the region up near the peak of the curve where the heat generated by the shearing of the oil film is not large. Therefore, the traction coefficient at slip ratio of 5% was chosen as the object.

EXAMPLE 1

The following components were added into a 4-necked flask, 240 g of commercially available 1,2,4-trimethyl benzene and 20 g of industrial grade 92% paraformaldehyde. Then, under mild agitation, 75 g of commercially available 75% dilute sulfuric acid was dropwise added thereto.

After the addition was completed, the reaction mixture was heated to 100°–110° C. by the use of an oil bath, and the reaction mixture was kept at that temperature under vigorous agitation for 3 hours. After completion of the reaction and cooling the reaction mixture to room temperature, the reaction mixture was transferred to a funnel and left to stand. The lower layer which separated consisted of a sulfuric acid solution and was removed. To the remainder, there were added 100 ml of n-butanol and 200 ml of water. Then the whole mixture was well agitated and thereafter left to stand. As an oily layer and a water layer clearly separated, the water layer was discarded. Subsequently, water washing of the oily layer was repeated 2–3 times until the washings had a pH value of 7. The oily layer was then transferred to a distillation flask for vacuum distillation. The vacuum distillation, which was started at a pressure of 10 mm Hg and ended at a pressure of 1 mm Hg, yielded 68 g of an aromatic compound consisting of two 1,2,4-methyl substituted benzene rings linked by a methylene group and having a melting point of 91° C. The aromatic compound was charged into an autoclave together with 10 g of a nickel catalyst and 200 g of cyclohexane as a solvent, and then hydrogenation was conducted after hermetically closing the autoclave. The conditions of the hydrogenation ware such that the initial hydrogen pressure was 70 kg/cm$^2$, the temperature was 200° C., and the reaction time was 6 hours. Subsequent processing consisting of cooling, filtering off the catalyst and solvent removal using a rotary evaporator gave 67 g of a naphthenic hydrocarbon consisting of two 1,2,4-methyl substituted cyclohexane rings linked by a methylene group. Table 2 gives the representative characteristics thereof.

TABLE 2

| | |
|---|---|
| Specific gravity (15/4° C.): | 0.878 |
| Kinematic viscosity (cSt @40° C.): | 13.6 |
| (cSt @100° C.): | 2.65 |
| Fluid point (°C.) | −30 |

The change in the traction coefficient of the above compound given indicated in the Figure.

COMPARATIVE EXAMPLE 1

The procedure of Example 1 was repeated except that 240g of commercially available 1,3,5-trimethyl benzene was used. Vacuum distillation gave 70 g of bis(2,4,6-trimethylphenyl)methane which corresponded to a distillate at 460° C. or below when converted to normal pressure.

The hydrogenation, separation of the catalyst, and removal of solvent were under the same conditions as in Example 1. The yield was 69 g of bis(2,4,6-trimethyl cyclohexyl)methane. Table 3 gives the representative characteristics thereof.

TABLE 3

| | |
|---|---|
| Specific gravity (15/4° C.): | 0.891 |
| Kinematic viscosity (cSt @40° C.): | 18.0 |
| (cSt @100° C.): | 3.05 |
| Fluid point (°C.): | −17.5 |

The change in the traction coefficient of the above compound is also given in the Figure. The above compound is a ring isomer of the compound of the present invention, and there is a high similarity in chemical structure between the two. However, as it is obvious from the Figure, the compound of Comparative Example 1 had a very low traction coefficient and a high fluid point.

COMPARATIVE EXAMPLE 2

The procedure of Example 1 was repeated except that 240g of commercially available methyl ethyl benzene was used. Vacuum distillation gave 87 g of bis(methyl ethyl phenyl)methane which corresponded to a distillate at 460° C. or below when converted to normal pressure.

The hydrogenation, separation of the catalyst, and removal of solvent were under the same conditions as in Example. 1 to give 85 g of bis(methyl ethyl cyclohexyl)methane. Table 4 gives the representative characteristics thereof.

The change in the traction coefficient of the above compound is given in the Figure. The above compound has the same number of carbon atoms as the compound of the present invention, and there is a similarity in chemical structure between the two. However, as it is obvious from the Figure, the compound of Comparative Example 2 had a very low traction coefficient.

TABLE 4

| | |
|---|---|
| Specific gravity (15/4° C.): | 0.845 |

TABLE 4-continued

| | |
|---|---|
| Kinematic viscosity (cSt @40° C.): | 13.2 |
| (cSt @100° C.): | 2.58 |
| Fluid point (°C.): | −50 |

COMPARATIVE EXAMPLE 3

The procedure of Example 1 was repeated except that 240g of commercially available xylene was used. Vacuum distillation gave 30 g of bis(xylyl)methane which corresponded to a distillate at 460° C. or below when converted to normal pressure.

The hydrogenation, separation of the catalyst, and removal cf solvent were under the same conditions as in Example 1 to give 30 g of bis(dimethyl cyclohexyl)methane. Table 5 gives the representative characteristics thereof.

TABLE 5

| | |
|---|---|
| Specific gravity (15/4° C.): | 0.835 |
| Kinematic viscosity (cSt @40° C.): | 7.06 |
| (cSt @100° C.): | 1.95 |
| Fluid point (°C.): | −45 |

The change in the traction coefficient of the above compound is given in the Figure. The number of carbon atoms of the substituents of the above compound is slightly different (2 less) than those of the compound of the present invention, and there is a similarity in the chemical structure between the two.

However, as it is obvious from the Figure, the compound of Comparative Example 3 had a very low traction coefficient.

COMPARATIVE EXAMPLE 4

The procedure of Example 1 was repeated except that 240g of commercially available diethyl benzene was used. Vacuum distillation gave 24 g of bis(diethyl phenyl)methane which corresponded to a distillate at 460° C. or below when converted to normal pressure.

The hydrogenation, separation of the catalyst, and removal of solvent were under the same conditions as in Example 1 to give 24 g of bis(diethyl cyclohexyl)methane. Table 6 gives the representative characteristics thereof.

TABLE 6

| | |
|---|---|
| Specific Gravity (15/4° C.): | 0.845 |
| Kinematic viscosity (cSt @40° C.): | 25.6 |
| (cSt @100° C.): | 3.66 |
| Fluid point (°C.): | −40 |

The change in the traction coefficient of the above compound is given in the Figure. Although there is a similarity in the chemical structure between the above compound and that of the present invention, the compound of Comparative Example 4 had a very low traction coefficient, as it is obvious from the Figure.

Based on the above description, the lubricating oil for traction drives of the present invention will always provide stable power transmission and enhanced efficiency because the lubricating oil for traction drives of the present invention always has a higher traction coefficient over a wide temperature range (from high temperature to low temperature) and, at the same time, has a low viscosity and because it is excellent in such properties as stability to heat and oxidation, corrosion resistance, etc., relative to the conventional lubricating oils for traction drives whose traction coefficient (the ratio of the tangential force to perpendicular load) markedly decreases as the temperature rises even though it is adequate at near room temperature or where their high viscosity causes efficiency to decrease.

While the invention has been described in detail and with reference to specific embodiments thereof, it will be apparent to one skilled in the art that various changes and modifications can be made therein without departing from the spirit and scope thereof.

What is claimed is:

1. A lubricating oil mainly composed of a naphthenic hydrocarbon having 19 carbon atoms comprising two cyclohexane rings which have methyl-substitution at the 1, 2, and 4 positions thereof, said two cyclohexane rings being linked by a methylene group.

* * * * *